US008550967B2

(12) United States Patent
Zuckerman

(10) Patent No.: US 8,550,967 B2
(45) Date of Patent: Oct. 8, 2013

(54) EXERCISE APPARATUS

(75) Inventor: Brian Zuckerman, Los Angeles, CA (US)

(73) Assignee: Swimworks, Inc., Los Angeles, CA (US)

( * ) Notice: Subject to any disclaimer, the term of this patent is extended or adjusted under 35 U.S.C. 154(b) by 0 days.

(21) Appl. No.: 11/258,835

(22) Filed: Oct. 25, 2005

(65) Prior Publication Data

US 2006/0073945 A1 Apr. 6, 2006

Related U.S. Application Data

(63) Continuation-in-part of application No. 10/949,729, filed on Sep. 24, 2004, now Pat. No. 7,591,764.

(51) Int. Cl.
*A63B 26/00* (2006.01)

(52) U.S. Cl.
USPC ..... 482/142; 482/92; 482/148

(58) Field of Classification Search
USPC ..... 482/51, 55, 56, 91, 126, 121–124, 129, 482/130, 142, 52, 54; 434/254; 601/23, 601/33–35, 24
See application file for complete search history.

(56) References Cited

U.S. PATENT DOCUMENTS

| | | | | | |
|---|---|---|---|---|---|
| 2,013,520 | A * | 9/1935 | McDermott | 482/56 |
| 2,019,224 | A * | 10/1935 | Hess | 482/56 |
| 3,976,058 | A * | 8/1976 | Tidwell | 601/24 |
| 4,416,293 | A * | 11/1983 | Anderson et al. | 600/595 |
| 4,725,057 | A * | 2/1988 | Shifferaw | 482/130 |
| 4,830,363 | A * | 5/1989 | Kennedy | 482/56 |
| 4,844,450 | A * | 7/1989 | Rodgers, Jr. | 482/56 |
| 4,867,720 | A * | 9/1989 | Harrington | 441/60 |
| 5,158,513 | A * | 10/1992 | Reeves | 482/56 |
| 5,366,426 | A * | 11/1994 | Glavin | 482/56 |
| 5,540,591 | A * | 7/1996 | Doane | 434/254 |
| 5,643,161 | A * | 7/1997 | Gordon | 482/127 |
| 5,688,210 | A * | 11/1997 | Chou | 482/56 |
| 6,042,510 | A * | 3/2000 | Miller | 482/51 |
| 6,066,075 | A * | 5/2000 | Poulton | 482/8 |
| 6,146,317 | A * | 11/2000 | Prusick | 482/130 |
| 6,764,431 | B2 * | 7/2004 | Yoss | 482/56 |
| 6,790,164 | B1 * | 9/2004 | Davis | 482/56 |
| 7,104,931 | B2 * | 9/2006 | Saul | 482/56 |
| 7,153,248 | B2 * | 12/2006 | Chen | 482/121 |
| 2005/0239616 | A1 * | 10/2005 | Tuller et al. | 482/121 |

FOREIGN PATENT DOCUMENTS

| | | | |
|---|---|---|---|
| GB | 2118849 | * 11/1983 | A63B 69/10 |

* cited by examiner

*Primary Examiner* — Glenn Richman
(74) *Attorney, Agent, or Firm* — Mintz Levin Cohn Ferris Glovsky and Popeo, P.C.

(57) ABSTRACT

An apparatus for replicating swimming, rowing, cycling or other exercise modalities. An apparatus includes a base, a frame extending up from the base, and a support member coupled to a top portion of the frame. The apparatus further includes a forward-ascending bench. The bench includes a torso support section to support a user's torso, pivotally coupled to the support member, and configured for limited angular rotation about an axis parallel to at least a portion of the support member. The bench further includes left and right leg support sections, pivotally coupled to the torso support section, to support at least the user's thighs. The apparatus also includes a coupling member extending forward from the base, and configured to interchangeably couple with an exercise module.

19 Claims, 13 Drawing Sheets

EXERCISE APPARATUS

CROSS REFERENCE TO RELATED APPLICATIONS

This application is a continuation-in-part of U.S. patent application Ser. No. 10/949,729, filed Sep. 24, 2004 now U.S. Pat. No. 7,591,764.

BACKGROUND

Exercise machines attempt to replicate work required by various muscles of the body to develop better physical fitness of those muscles and of the body in general. Since the early days of crude weight benches and simple stationary bicycles, exercise machines have been developed to be better for specific movements, more adaptable to a wider array of exercises, or more polished and advanced for easier production, marketing and distribution.

Some exercise machines have been developed to attempt to replicate a specific type of sport activity, such as biking, running, stair climbing, rowing and weight lifting. These machines offer variable resistance levels, computer program monitoring of vital statistics, and user-friendly control systems, all within a confined exercise space. However, typical sports activity-replicating machines such as stationary bikes, treadmills, stair-climbers, rowers, etc., can be only configured for one type of activity at a time.

Swimming, despite being one of the best forms of exercise, is one sport activity that is difficult to replicate on land due to the medium in which the original activity takes place. In water, a person is subjected to less gravitational force and substantially increased resistance in every direction under the surface of the water. Because of this medium, swimmers are known as having desirable physical attributes of more toned and balanced muscle mass, greater strength, and higher endurance than persons subjected to other forms of exercise or activity.

SUMMARY

Disclosed herein are apparatuses and systems for land-based replication swimming exercise. Further disclosed herein are apparatuses and systems for interchangeable exercise modalities that include replicated swimming exercises, biking, rowing, strength training, and other modalities.

In one embodiment, an exercise apparatus includes a base, a frame extending up from the base, and a support member coupled to a top portion of the frame, extending forward from the frame. The apparatus further includes a forward-ascending bench. The bench includes a torso support section to support a user's torso, pivotally coupled to the support member, and configured for limited angular rotation about an axis parallel to at least a portion of the support member. The bench further includes left and right leg support sections, pivotally coupled to the torso support section, to support at least the user's thighs. In an exemplary embodiment, the bench further includes adjustable left and right wing sections extending from opposite sides of the torso support section. The apparatus also includes a coupling member extending forward from the base, and adapted to interchangeably couple with an exercise module.

In another embodiment, an exercise apparatus includes a frame extending up from a base, and a coupling member. The coupling member extends forward and rearward from the base, and has forward and rearward coupling interfaces. Each coupling interface is adapted to releasably couple with an interchangeable exercise module. The apparatus further include a support member coupled to and extending forward from a top portion of the frame, and an articulated bench, adapted for being coupled to the support member or the exercise module. The bench includes an upper support section, and left and right lower support sections pivotally coupled with the upper support section.

In yet another embodiment, an exercise system includes a frame module and one or more interchangeable exercise modules. The frame module includes a base, a frame extending up from the base, a resistance mechanism mounted to the frame, a coupling member extending forward and rearward from the base and having forward and rearward coupling interfaces, and a support member coupled to and extending forward from a top portion of the frame. Each exercise module includes an attachment member adapted to releasably connect with the coupling member and to cooperate with the resistance mechanism to provide an exercise modality. The system further includes an articulated bench, adapted for being coupled to the support member or the attachment member based on the exercise modality then being used.

The details of one or more embodiments are set forth in the accompanying drawings and the description below. Other features, objects, and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes an exercise apparatus and system for replicating swimming exercises and other exercise modalities. In accordance with various embodiments, the exercise apparatus provides for a swimming exercise mode, in which the resistance paths as well as resistance amount of arm and leg movements in swimming motions are accurately reproduced. For example, the exercise apparatus is adapted to provide nearly obstruction-free movement of a user's arms and hands when the user is laying on a bench in a substantially horizontal position, and to simultaneously provide free movement, of at least a user's lower legs, particularly in vertical up-and-down movement. Accordingly, the configuration of the apparatuses and systems described herein uniquely provide for a swimming type workout, among other exercise modalities, without a user having to get into the water.

Figure 1:
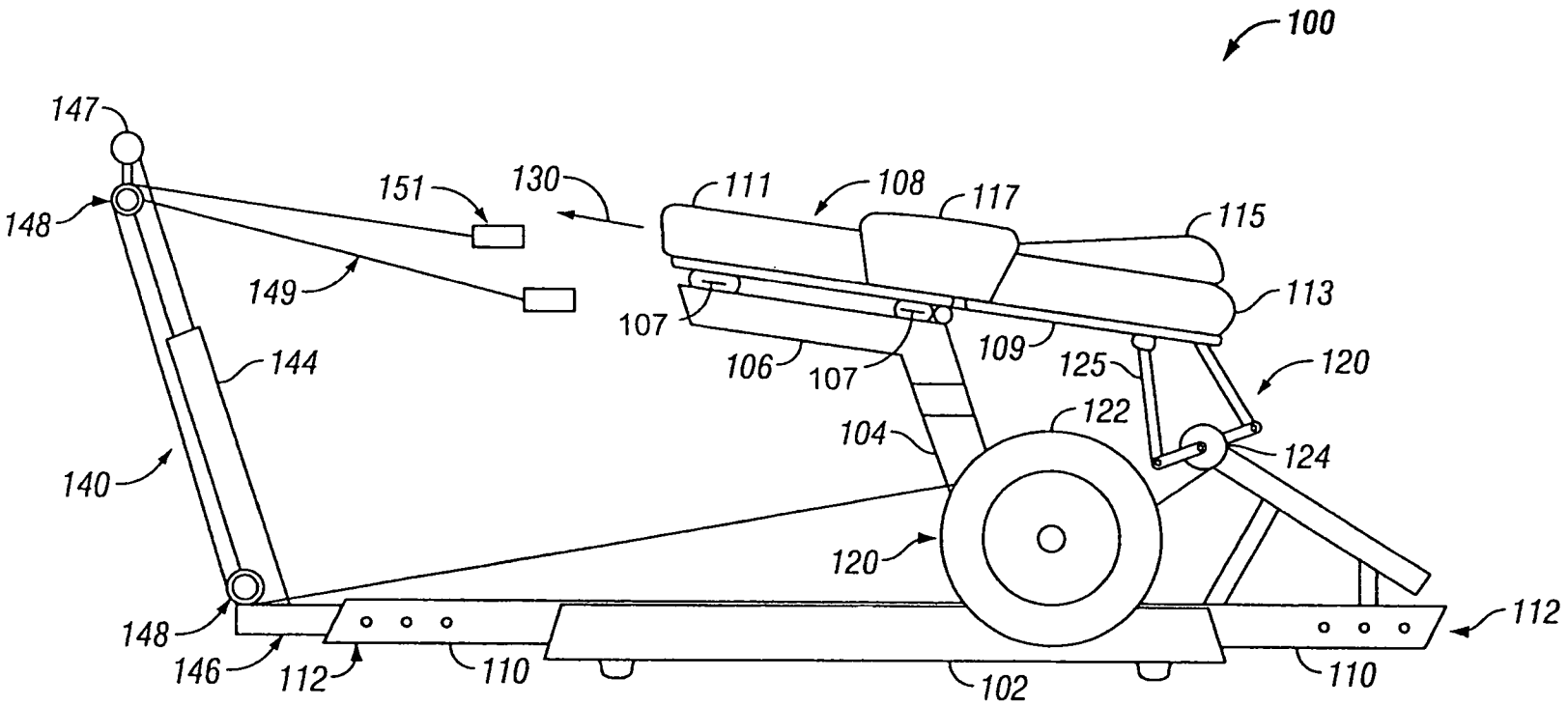
FIG. 1 is a side view of an exercise apparatus according to a first embodiment.

FIG. 1 is a side view of an exercise apparatus 100 according to a first embodiment. The apparatus 100 includes a base 102, a frame 104 coupled to and extending upward from the base 102, and a support member 106 coupled to and extending forward from a top portion of the frame 104. The base 102, frame 104, and support member 106 can be constructed of any rigid, weight-bearing and stress-resistant material, such as tubular or solid steel, aluminum, or other metal, nylon or any other suitable synthetic material.

The apparatus 100 further includes a bench 108 that ascends in a forward direction aligned with at least a portion of the support member 106. The bench 108 can be formed of a bendable but rigid lower layer 109 and a cushioning material applied to the lower layer 109. The cushioning material can be foam, thermoformed honeycomb, or any other cushioning material. The bench 108 is configured to provide multiple, independent axes of rotation for a user laying upon it, yet facilitates an ease of a user to get on or off the bench 108. The rotation can be configured to be variable, and adjusted according to two or more rotational range settings. In an embodiment, the bench 108 is adjustable in all coordinate axes for adjustability and comfort for a wide range of user's body types and weights. For instance, the bench 108 may include an indented area having an adjustable indentation for accommodating the bust area of women users. In another example, the bench is operable for being electro-mechanically raised or lowered.

The bench 108 includes a torso support section 111 that is pivotally coupled to the support member 106 to support a user's torso, and left and right leg support sections 113 and 115 that are pivotally coupled to the torso support section 111 to support at least the user's thighs. The torso support section 111 is preferably attached by pivoting members 107 that allow for limited angular rotation of the torso support section 111 about an axis 130 that is parallel to at least a portion of the support member 106. The bench 108 can also include left and right wing sections 117 extending from opposite sides of the torso support section 111 to cradle a user in operation. The bench 108 and/or torso support section 111 can also be attached to the apparatus 100 by a rail or track to allow the bench 108 and/or torso support section 111 to move forward or backward. Wings can extend laterally or retract, fold up or down for cradling.

The apparatus 100 includes a coupling member 110 that extends forward and/or rearward from the base 102. The coupling member 110 has at least one coupling interface 112 adapted to interchangeably couple with an exercise module 140. In an embodiment, the coupling member 110 has front and rear coupling interfaces 112. The coupling interface 112 can include a hollowed interior portion of a tubular member, but can be configured as any type or arrangement suitable for releasably coupling the exercise module 140 to the rest of the apparatus 100, so that various exercise modules can be interchanged to accommodate multiple exercise modalities.

The apparatus 100 further includes a resistance mechanism 120 mounted to the frame 104 or base 102. The resistance mechanism 120 is adapted to cooperate with the exercise module 140 to provide the desired exercise modality. In one embodiment, the resistance mechanism 120 includes at least one variable resistance device 122, including, but not limited to, a flywheel, caliper brakes, alternator/generator, electromagnetic or electromechanical clutch, hydraulic resistance device, centrifugal clutch, one or more weights or a weight stack, or a spring or coiled resistance. The flywheel may be mechanical, such as a wind-resistance flywheel, electromechanical, or electromagnetic. In an embodiment, the resistance mechanism 120 includes two or more separate resistance devices. For instance, the variable resistance device 122 can include a flywheel connected for providing a first resistance, such as to a user's arms, and a clutch or crank assembly 124 for providing a second resistance, such as to a user's legs. Those having skill in the art will recognize that any combination and number of resistance devices can be used with any embodiment described herein, such as leaf springs and/or hydraulic damper.

As an example, FIG. 1 shows the apparatus 100 configured for a swimming exercise mode. The exercise module 140 includes an attachment mechanism 146 that couples to the coupling interface 112. In one embodiment, the attachment mechanism 146 is a rigid beam that slides into and locks within a cavity of the coupling interface 112. The exercise module 140 further includes a trunk member 144 that extends upward from the attachment mechanism 146, and left and right branch members 147. Each branch member 147 is coupled to a pulley 148 that is positioned for guiding a link 149 coupled between the resistance mechanism 120 and a user-controlled resistance activation device 151. The link 149 can include a cable, band, chain, and/or any other type of link. The user-controlled resistance activation device 151 can include a hand paddle connected to a cable, for instance. The resistance activation device 151 may also be a pedal and crank assembly such as used with a recumbent bicycle modality, or any other device that can be manipulated or moved by a user.

Figure 2:
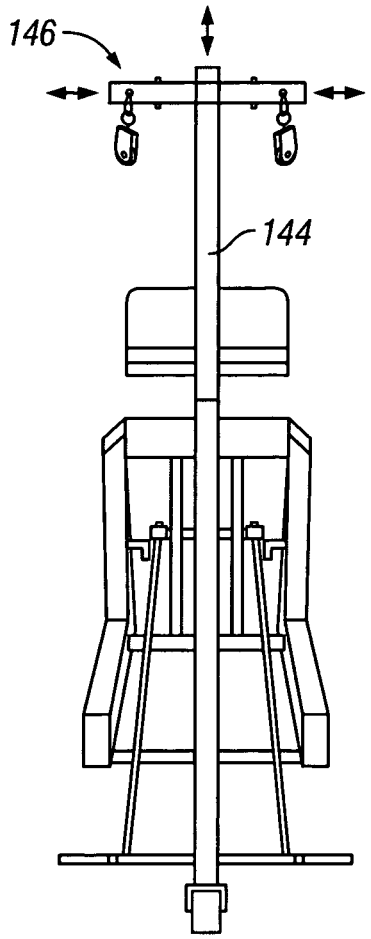
FIG. 2 is a frontal view of the exercise apparatus according to the first embodiment.

FIG. 2 is a frontal view of the exercise apparatus according to the first embodiment. The trunk member 144 may be telescopic, or otherwise adjustable to a vertical height desired by a user. A telescopic trunk member 144 can be formed of at least one beam slidably interfacing with another beam, and locked into a desired position by a pin or other locking member. The branch members 147 may also be telescopic and/or jointed, so that they may be adjustable to a particular position in the lateral, forward and/or backward direction. In an embodiment, the branch members are connected to the trunk member by a joint. The adjustability of the trunk member 144 and branch members 147 can be electrical, mechanical, or a combination thereof, and the process of adjustment by a user may be performed manually or automatically via a control interface.

Figure 3:
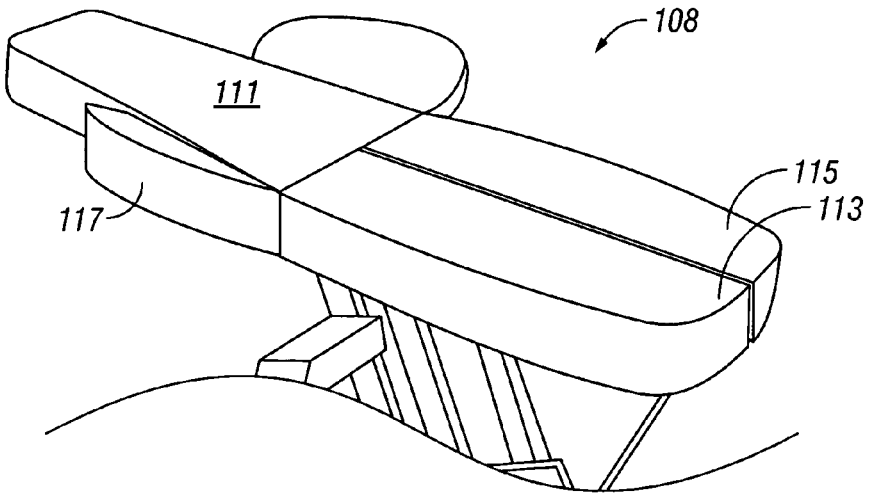
FIG. 3 is a perspective view of the exercise apparatus according to the first embodiment.

FIG. 3 is a perspective view of the exercise apparatus according to the first embodiment, to illustrate the composition and orientation of the bench 108. As discussed with reference to FIG. 1, the bench 108 provides multiple independent axes, of limited angles, of rotation of a user's body. The 108 includes a pivoting torso support section 111, left and right leg support sections 113 and 115 that are pivotally coupled to the torso support section 111 and left and right wing sections 117 extending laterally from opposite sides of the torso support section 111 to cradle a user. In an alternative embodiment, the torso support section 111 may be formed of two or more independently rotatable sections for a greater range of rotation. The top of the bench 108 can include a water- and/or sweat-proof coating.

Figure 4:
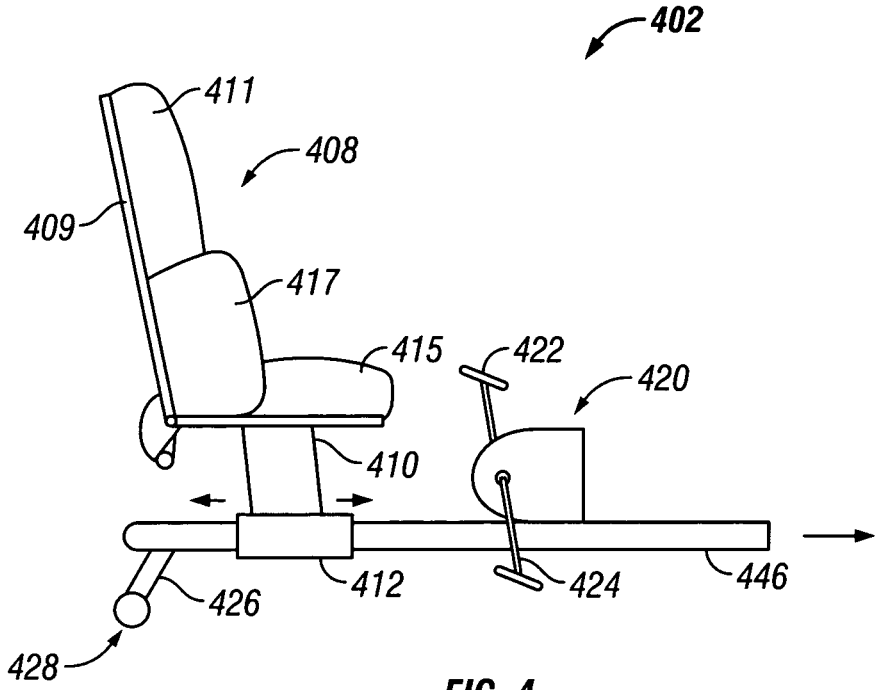
FIGS. 4 and 5 illustrate alternative interchangeable exercise modules for use with an exercise system.
Figure 5:
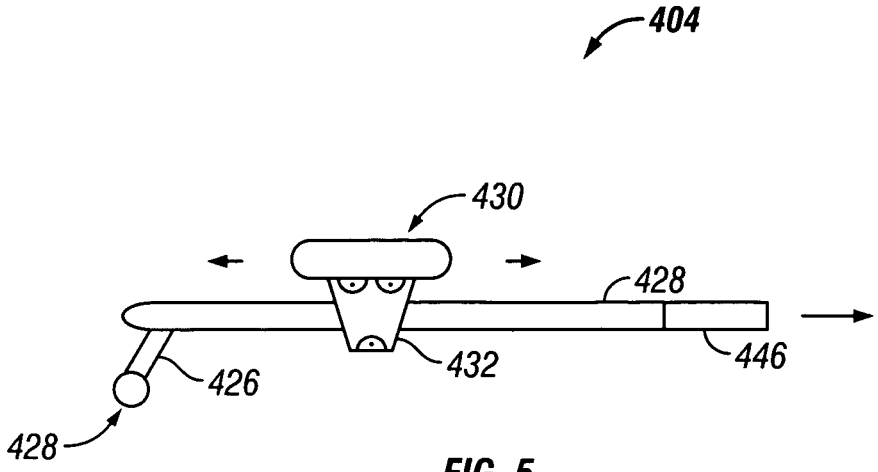
Figure 6A:
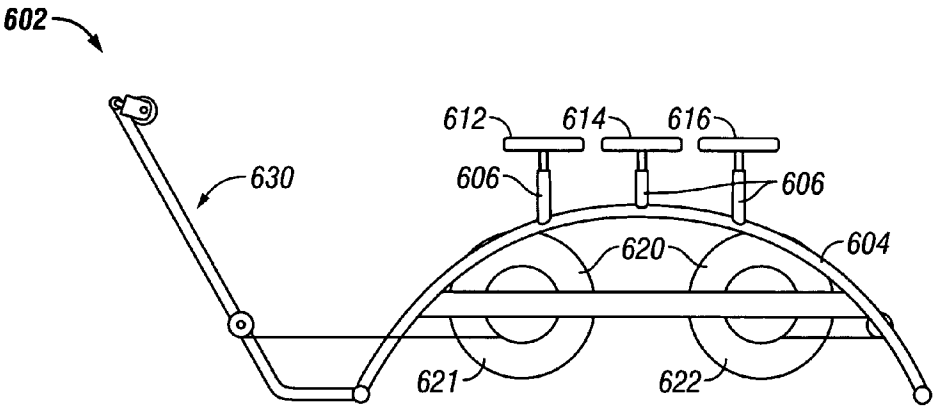
FIGS. 6A-6C are assorted views of an alternative embodiment of an exercise apparatus.
Figure 6B:
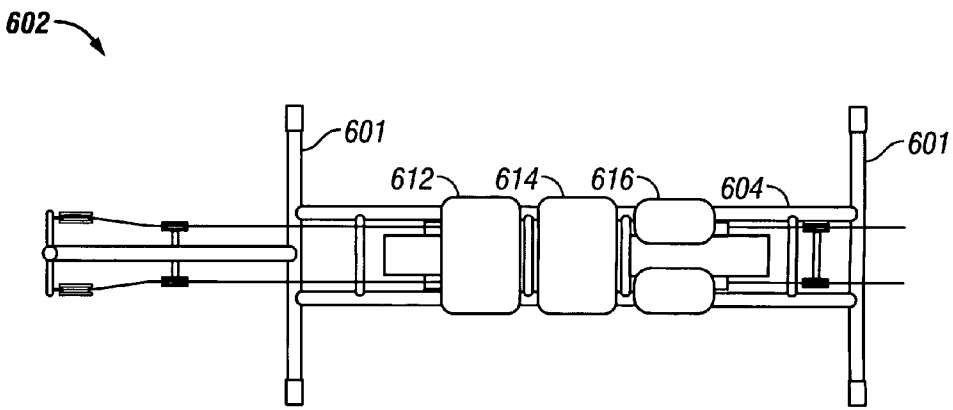
Figure 6C:
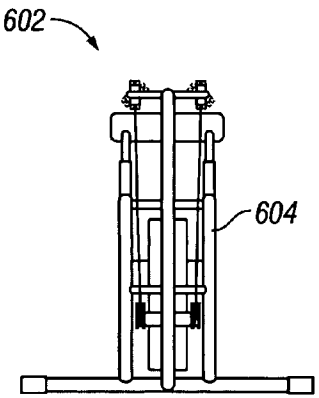

FIGS. 4 and 5 illustrate alternative interchangeable exercise modules for use with an exercise system. FIG. 4 shows a recumbent bicycle module 402, and FIG. 5 shows a rower module 404. Other modules for various other exercise modalities are possible. Each of the modules 402 and 404 include an attachment mechanism 446 that is configured to attach to a coupling interface of the rest of an exercise apparatus, as substantially described above with reference to FIG. 1. The modules 402 and 404 can also include one or more legs 426 for supporting the module in a particular vertical position. Each leg 426 may include a caster 428 or other rolling mechanism for facilitating attaching the module to the rest of the exercise apparatus.

The recumbent bicycle module 402 includes a bench 408 having a rigid layer 409 with both back and seat support parts. The bench 408 further includes a torso support section 411, and a seat support section 415, each having a cushioning layer. The bench 408 can further include left and right wing sections 417. In one embodiment, the bench 108 is configured for being interchangeable between the swimming exercise mode and the recumbent bicycle module 402. The bench 108 can be either locked in a folded position for use as a bicycle seat, as shown by bench 408, or locked in a flattened position for use in the swimming exercise mode, as shown by bench 108 of FIG. 1.

The bench 408 is connected to the attachment mechanism 446 by a seat stand 410 and seat coupling mechanism 412. The seat coupling mechanism 412 can be adjusted for coupling at various locations along the horizontal length of the coupling mechanism 446. The module 402 may also include hand grips (not shown), coupled to either the bench 408 or the seat stand 410, for a user to grasp when exercising. The module 402 further includes a pedal and crank assembly 420. The pedal and crank assembly 420 includes a crank 424 connected to a device such as a sprocket or other resistance leverage mechanism, and left and right foot pedals 422. The pedal and crank assembly 420 is connected to the resistance mechanism of the exercise apparatus by a chain or other linking mechanism.

With reference to FIGS. 1 and 4, a strength training exercise apparatus may be formed by combination of bench 408 with the exercise module 140. For example, the bench 408 may be connected with the coupling member 110 and/or to coupling interface 112 (at the front or rear of the apparatus 100), such that a user can operate the resistance mechanism 120 by links 149. The bench 408 may face forward or rearward, and can be configured to be spun and locked into either position. Further, the bench 408 can be configured to tilt for exposing any of the user's muscles to direct resistance. In alternative embodiments, the bench 408 can be connected to the base 102, frame 104, support member 106, or attachment mechanism 146. For example, the bench 408 can be mounted to the support member 106, which may in turn be raised or lowered. The bench 408 can have a swimming exercise mode, in which it lays flat, and a strength training mode, in which it folds up to form a chair.

The rower module 404 shown in FIG. 5 includes a track member 428 including an elongated track, and a seat 430 slidably mounted in the track by a mounting mechanism 432. The mounting mechanism 432 can include one or more rollers or wheels that permit forward and backward movement of the seat 430. The seat 430 may be a simple one-piece seat, or include multiple support sections as the bench 408 shown in FIG. 4. In another embodiment, the seat 430 is stationary, and the track member 428 can include foot rests to provide leverage to a user who can engage and pull a chain or cable connected to the resistance mechanism of the exercise apparatus.

FIGS. 6-9 are assorted views of various alternative embodiments of an exercise apparatus. FIGS. 6A-6C show a side, top-down and front view, respectively, of an exercise apparatus 602. The apparatus 602 includes a base 601 comprised of lateral parallel bars, and a frame 604 comprised of two parallel arcuate frame members, as illustrated in FIG. 6B. The apparatus 602 further includes a support member 606 coupled to a top portion of the frame 604, comprised of a number of vertical posts, and a split bench comprised of an upper torso support section 612 to support a user's upper torso, a lower torso support section 614 to support a user's mid-section, and left and right leg support sections 616. The bench components can be attached to the frame 604 by a number of shocks. Each of the sections of the bench are movable with respect to the frame 604, either pivotally coupled for limited angular rotation about a longitudinal axis of the apparatus 602, or for limited up-and-down movement.

The apparatus 602 includes a resistance mechanism 620 having a forward resistance mechanism 621 for providing resistance to a user's arms, and a rear resistance mechanism 622 for providing resistance to a user's legs. An exercise module 630 is coupled to the frame 604 or base 601, and can be folded or disengaged for storage of the apparatus 602.

Figure 7A:
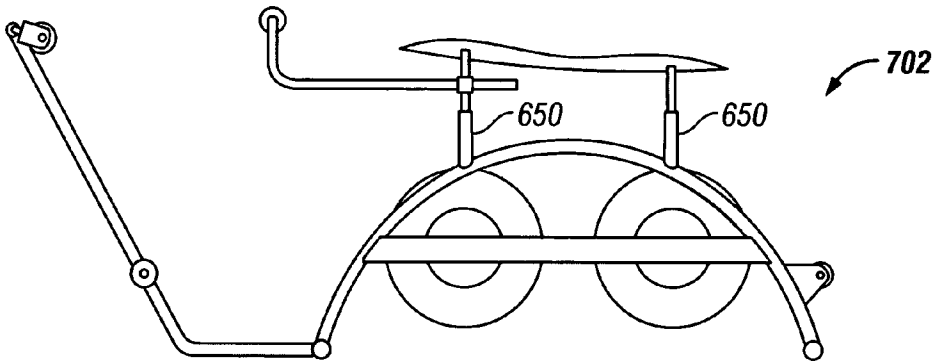
FIGS. 7A-7C are assorted views of another alternative embodiment of an exercise apparatus.
Figure 7B:
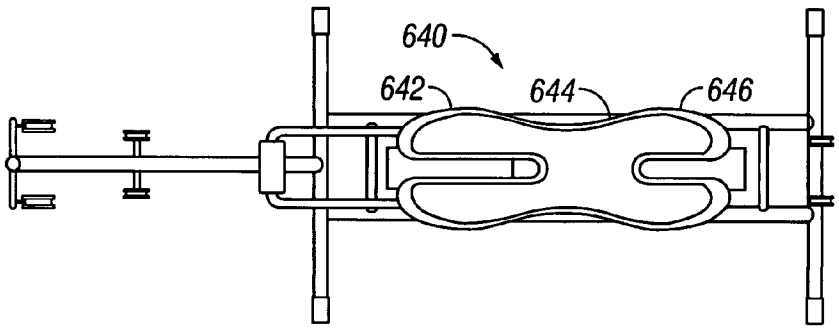
Figure 7C:
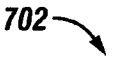
Figure 7C:
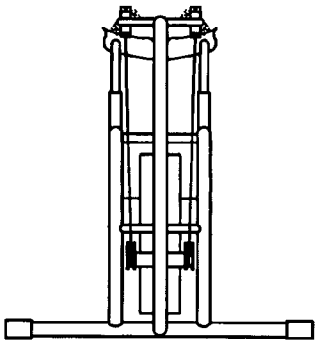

FIGS. 7A-7C show a side, top-down and front view, respectively, of an exercise apparatus 702 having a unitary bench 648. The unitary bench 648 includes left and right arms 642 and left and right legs 646, each flexibly connected to a midsection support 644, for allowing movement of a user's upper torso and shoulders and upper legs, respectively. The arms 642 and legs 646 of the bench 640 can be connected to the frame by shocks 650 or other biasing mechanisms. The unitary bench 648 can be formed of a resilient, stiff material such as plastic or carbon fiber, and may include several layers such as a stiffened lower layer and a padded upper layer.

Figure 8B:
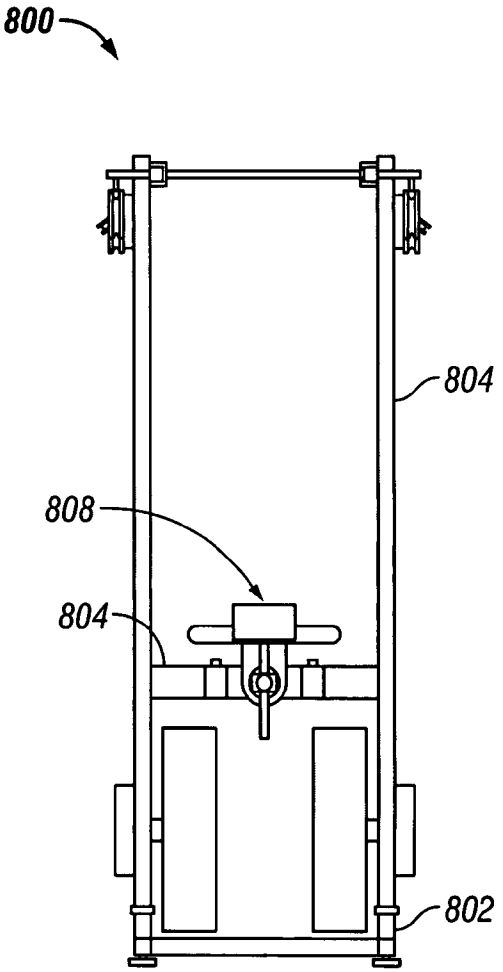
FIGS. 8A and 8B are respective side and frontal views of another alternative embodiment of an exercise apparatus.
Figure 8A:
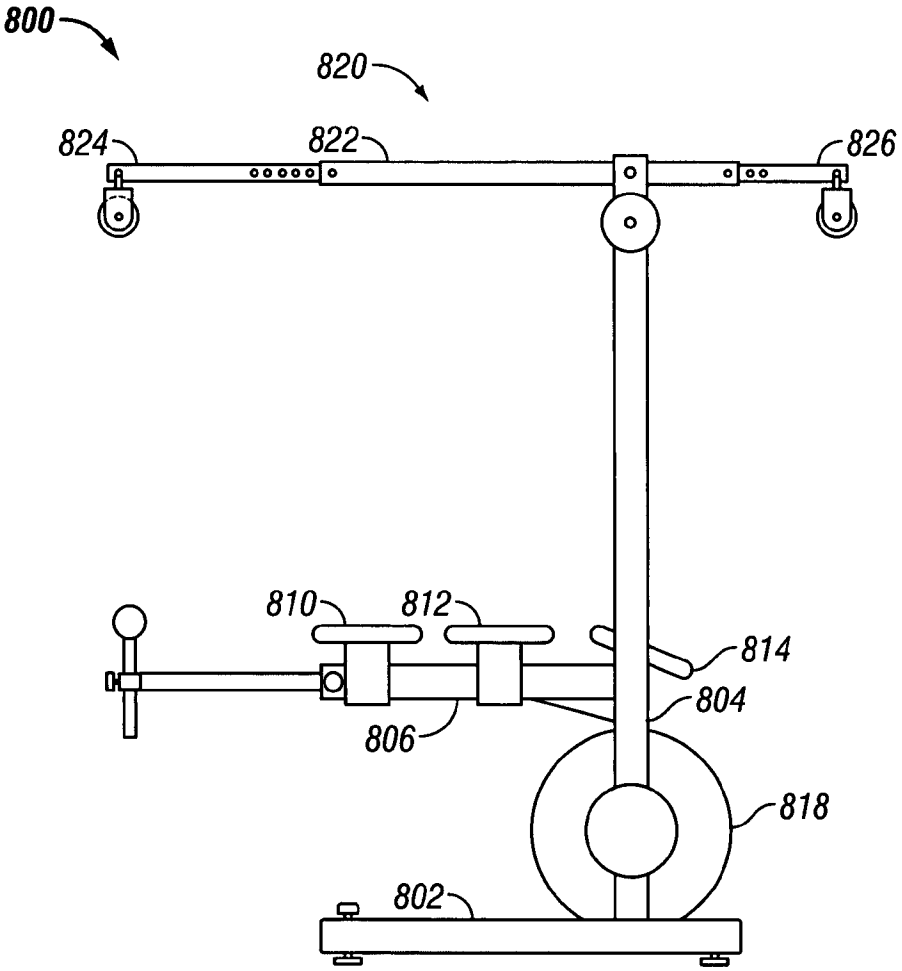

FIGS. 8A and 8B are respective side and frontal views of another alternative embodiment of an exercise apparatus 800. The apparatus 800 includes a base 802, and a frame 804 comprised of parallel beams extending substantially vertically from the base 802 and having a horizontal connection beam. A support member 806 extends forward from the frame 804, and supports a multi-sectioned bench 808. The bench 808 includes a torso support section 810, a midsection support section 812, and left and right thigh support sections 814.

The apparatus 800 includes an attachment module 820 having parallel longitudinal members 822 coupled to the top of respective parallel vertical beams of the frame 804. Each longitudinal member 822 includes a forward extending member 824 and a rear extending member 826, each telescoping to a desired length and coupled to a pulley for accommodating a cable connected to a resistance mechanism 818. The apparatus 800 thus provides resistance from above a user.

Figure 9A:
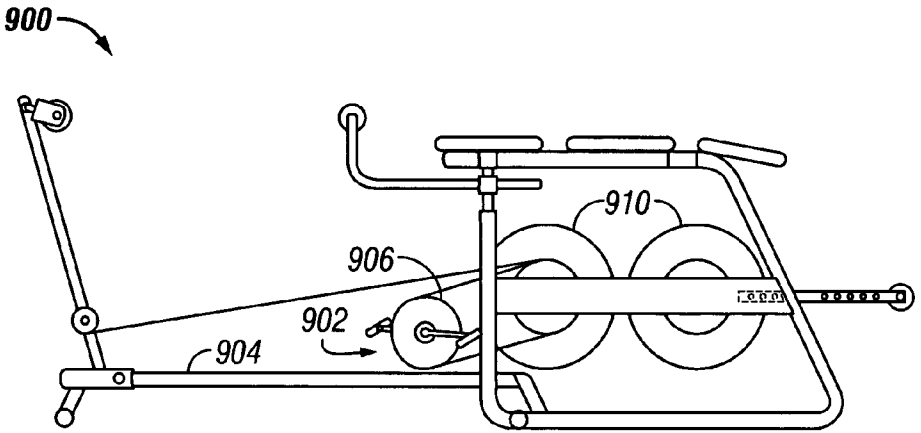
FIGS. 9A-9C are assorted views of yet another alternative embodiment of an exercise apparatus.
Figure 9B:
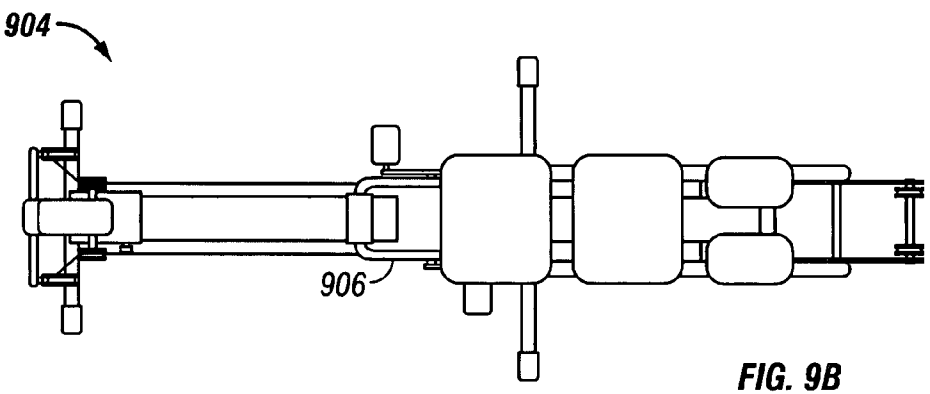
Figure 9C:
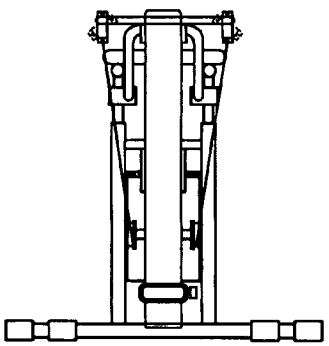

FIGS. 9A-9C are assorted views of yet another alternative embodiment of an exercise apparatus 900, showing an integrated exercise module 902 and removable exercise module 904. The integrated exercise module 902 includes a pedal and crank assembly 906, that may be coupled directly to a resistance mechanism. The integrated exercise module 902 may be used either by removal of the removable exercise module 904 and replacement by an alternative exercise module (not shown), or by attachment of the alternative exercise module, for example to a rear portion of the exercise apparatus 900. In the example shown, the alternative exercise module can include a seat for a recumbent bicycle.

Figure 10:
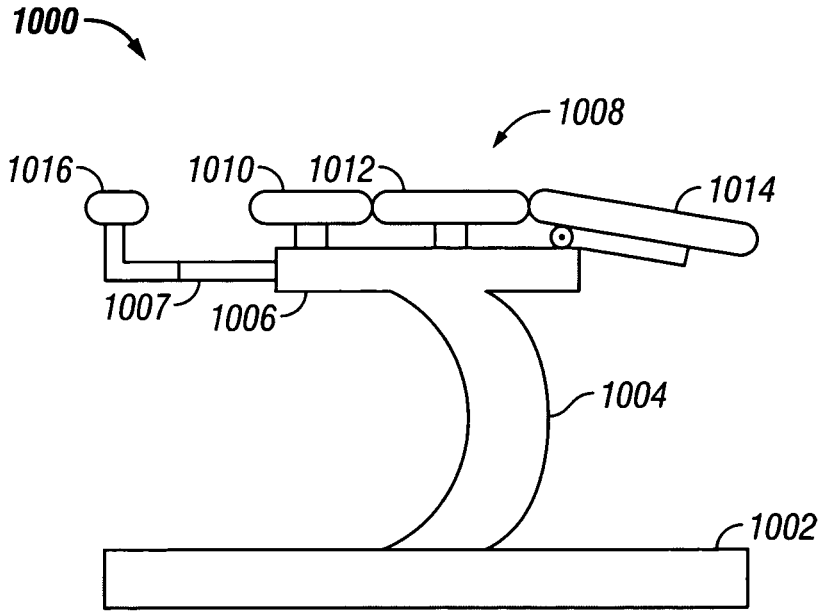
FIG. 10 illustrates an apparatus for instructing a person.

FIG. 10 illustrates an instruction apparatus 1000 for a land-based pool-free method of instructing a person on swimming techniques. The apparatus 1000 includes a base 1002, a frame 1004, and a support member 1006. The base 1002 anchors the apparatus to a stationary position on a substantially planar surface. The frame 1004 provides the support 1006 to a particular height, and can be adjustable to provide multiple, adjustable heights as well as angles of the support 1006.

The apparatus 1000 also includes a bench 1008 that has two or more sections having independent, limited ranges of rotation with respect to a common axis. The bench 1008 can be multi-sectional or of unitary construction. In an embodiment, the bench 1008 includes an upper torso support 1010, a mid-section support 1012, and two leg supports 1014, each of which have their own rotation and/or angle of movement. The apparatus 1000 may also include a headrest 1016 extending from the support member 1006 via support connector 1007. The headrest 1016 may also be rotational. Each rotational section can be biased by a spring or gas-loaded shock absorber or other resistive device.

In a preferred embodiment, the apparatus 1000 is constructed of a light-weight metal or plastic, can be disassembled or compressed for portability, and set-up for rigid weight-bearing operation. The bench 1008 may be adjustable for person's of various size or weight, and may include wing sections that extend from opposing sides of the bench 1008.

In operation, the bench 1008 is adjusted to a predetermined height and/or angule. This can be done by adjusting the support member 1006 and/or frame 1004. A person is then placed on the bench 1008 and positioned on the bench 1008 at the appropriate location. Next, the person simulates swimming techniques, including but not limited to arm strokes, leg kicks, breathing, head turns, trunk rotation, body arching, or streamlined body position. Other swimming techniques may be simulated. The person may also be provided resistance in order to train specific muscles. The resistance may be applied in a guided path to promote accomplishment of a specific technique for repeated action and muscle memory development. For example, resistance or weight may be provided to one or more of the person's limbs.

Figure 11:
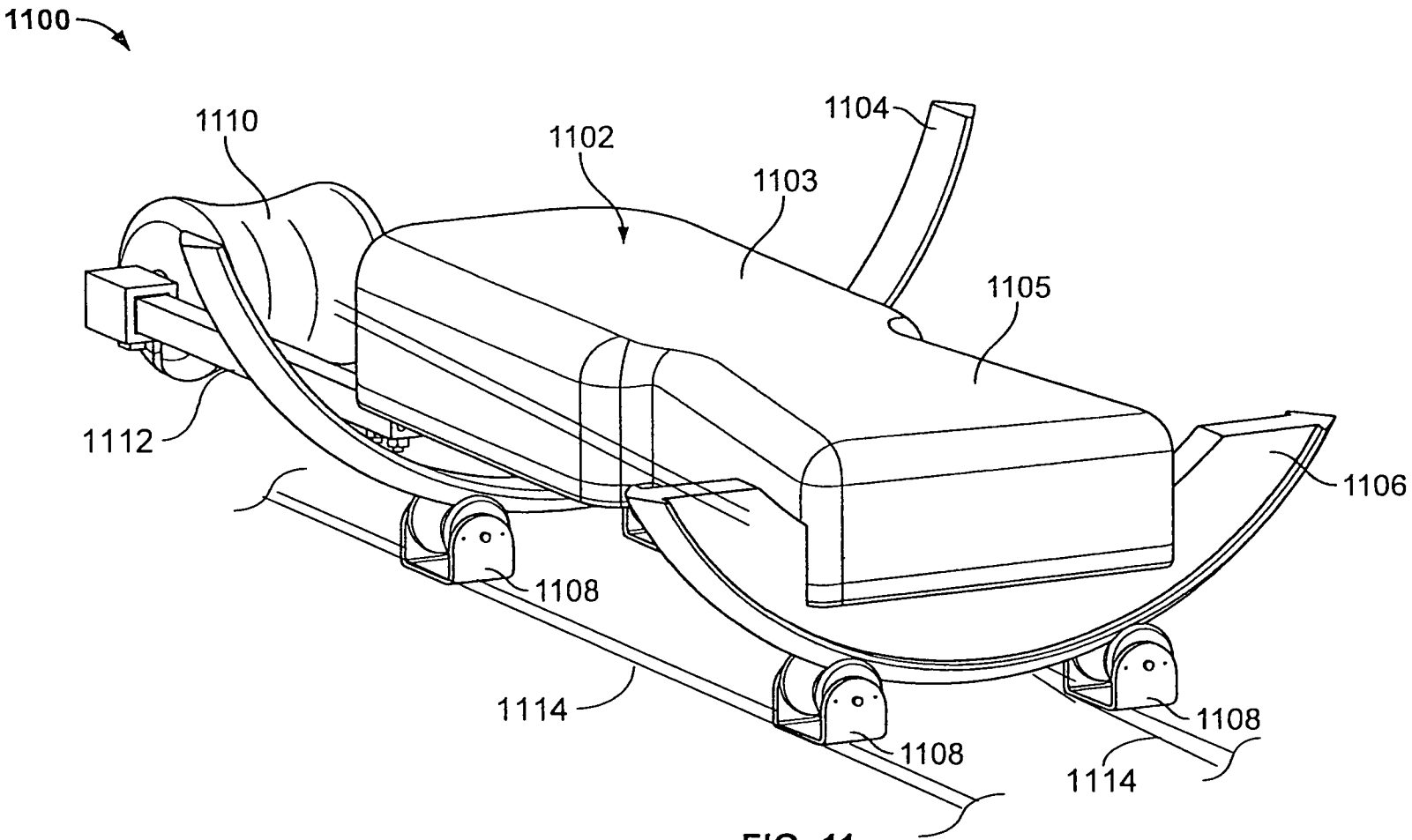
FIG. 11 is a rear perspective view of a bench assembly.

FIG. 11 is a rear perspective view of a bench assembly 1100. The bench assembly 1100 includes a torso support 1102 having an upper torso support area 1103 and a lower torso support area 1105. The upper torso support area 1103 supports a user's chest, while the lower torso support area 1105 supports a user's lower waist and/or upper legs such as thighs, hips, etc. The torso support 1102 can be formed of one or more layers of material (not shown), ranging from a rigid or resilient lower layer and a soft, padded upper layer. The torso support 1102 is configured to rotate along with a user's body while the user operates an exercise device.

In some embodiments, the upper torso support area 1103 and the lower torso support area 1105 rotate independently about a longitudinal axis that runs along a length of the torso support 1102. In the embodiment shown, the upper torso support area 1103 is connected to an upper guide rail 1104, while the lower torso support area 1105 is connected to a lower guide rail 1106. Each guide rail 1104 and 1106 is configured to provide rotational movement about the longitudinal axis. In the embodiment shown, the upper and lower guide rails 1104, 1106 are curved bars that each sit within and move through a pair of rollers 1108. The rollers 1108 can include detents to receive a guide rail. The rollers 1108 can in turn be attached to the rest of an exercise apparatus, as will be described below.

The bench assembly 1100 also includes a head rest 1110. The head rest 1110 can be stationary, or can also have an independent degree of rotation. The head rest 1110 is preferably connected to the rest of the bench assembly by extension bars 1112. The extension bars 1112 can adjust inward or outward to accommodate any size user.

The torso support 1102 is configured to rotate up to 90 degrees in either right or left direction, for a total angular rotation of 180 degrees. In some preferred embodiments, the total angular rotation is no more than 90 degrees (45 degrees of freedom in each direction). In some embodiments, an amount of resistance provided by the torso support 1102 is proportional to a degree of rotation of the torso support 1102.

The bench assembly 1100 can also be connected to an exercise device by a track or rail 1114, such that the bench assembly or torso support 1102 can move forward and backward. The forward and backward movement can be configured for free sliding, or may include adjustable resistance to accommodate a user's weight or particular exercise movement. The forward and backward movement capability can be combined with the rotational capability to provide multi-dimensional movement of the bench assembly 1100 or torso support 1102 with respect to an exercise device to which it is attached.

Figure 12:
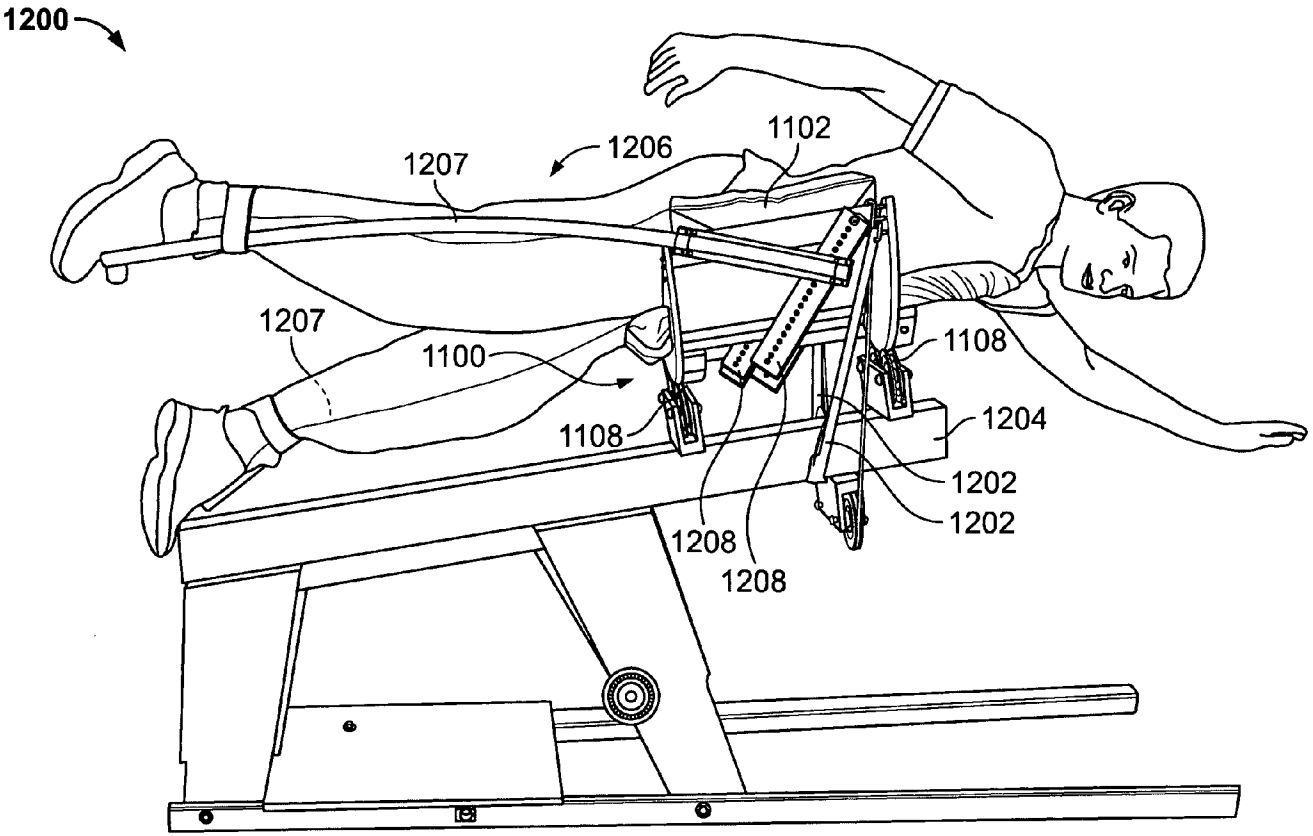
FIG. 12 illustrates an exercise device having a bench assembly and leg resistance rods.

FIG. 12 illustrates an exercise device 1200 incorporating a variant of the bench assembly 1100 which includes the rotational torso support 1102. The rollers 1108 of the bench assembly 1100 are connected to a support mechanism 1204 of the exercise device 1200. The support mechanism 1204 can be a rigid bar made of steel, aluminum or a composite material, or other stiff weight-bearing material. The support mechanism 1204 can be angled slightly upward toward a top end, or adjustable to a particular angle.

The exercise device 1200 also includes a rotation resistance mechanism 1202 coupled between the bench assembly 1100 and the support mechanism 1204 to provide resistance against free rotation of the torso support 1102. The resistance mechanism 1202 can include one or more stretchy resistance bands, a hydraulic shock assembly, or springs or the like. The resistance mechanism 1202 can also be dynamically adjustable to provide greater or lesser resistance.

The exercise device 1200 includes a leg resistance mechanism 1206. The leg resistance mechanism 1206 includes one or more leg resistance members 1207. The leg resistance members 1207 can be elongated cylindrical rods or flattened slats. The leg resistance members 1207 can be formed of a resilient and bendable material such as wood, composite fiber materials such as fiberglass or other composites, or other resilient and bendable materials. In some embodiments, the leg resistance members 1207 are connectable to a user's leg or ankle at a first end, and are connected to the bench assembly 1100 at a second end. Additional leg supports, such as a pad, netting or foam, may be positioned adjacent the leg resistance mechanism 1206.

The resistance provided by the leg resistance members 1207 can be adjustable in several ways. In some embodiments, the exercise device 1200 includes an adjustment track 1208 connected to the second end of each leg resistance member 1207. The adjustment track 1208 includes a groove or a series of holes, into which a peg or pin connected to the leg resistance member 1207 can be inserted for positioning the leg resistance member 1207 at a particular angle. The angle provides a particular level of resistance for upward and/or downward bending of the first end of the leg resistance member 1207.

The leg resistance members 1207 may also be adjustable in the form of two or more resistance members that cooperate together to provide a calculated level of resistance. For example, a number of resistance members can be connected together during an exercise by the user to form an additive level of resistance. Alternatively, the leg resistance members 1207 can be formed of multiple, telescoping resistance members. A center resistance member provides the least amount of resistance, which can be added to by telescoping out extending additional layers or sleeves over the center resistance member. To lessen resistance, the layers or sleeves can be individually retracted.

Figure 13A:
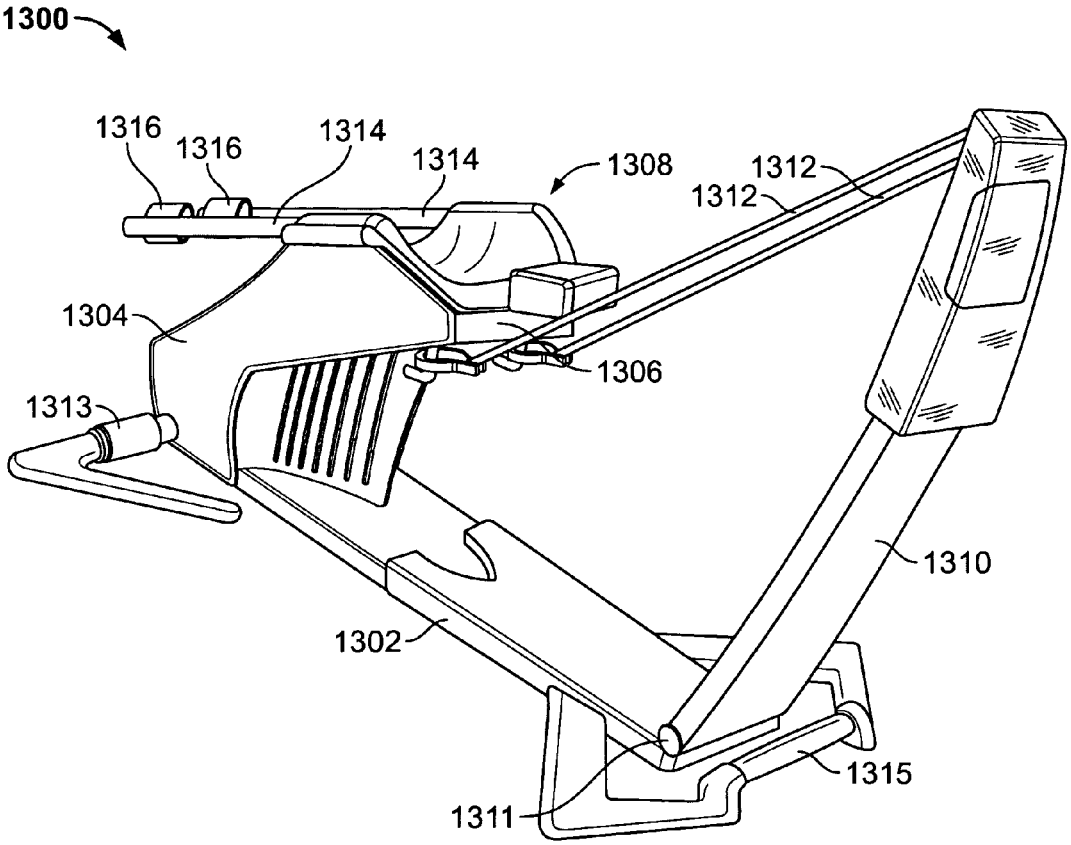
FIG. 13 illustrates an exercise device according to an exemplary and embodiment apparatus.
Figure 13B:
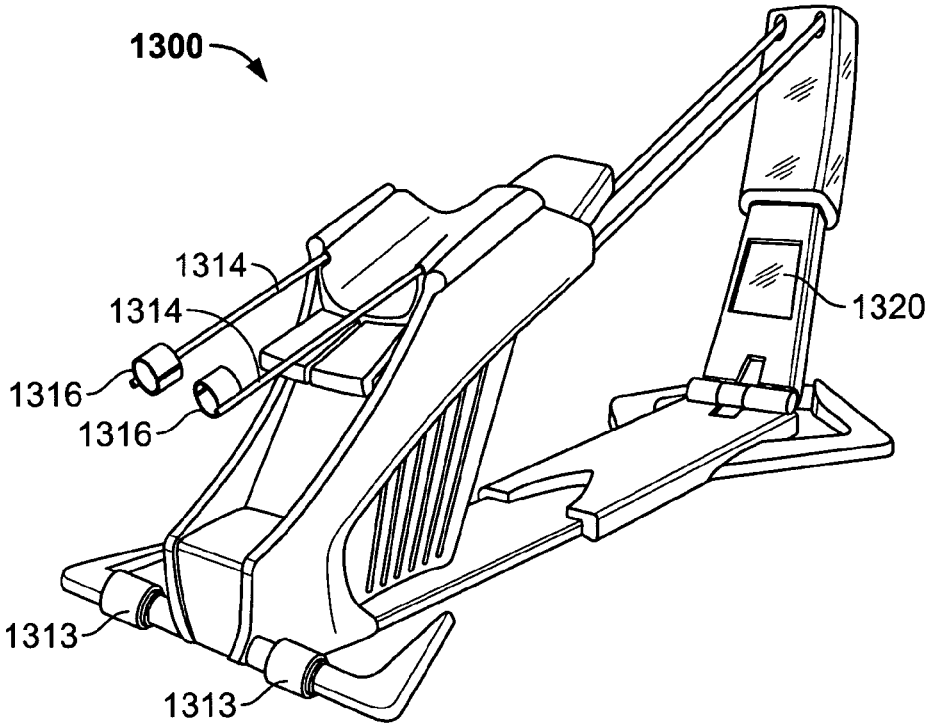
Figure 13C:
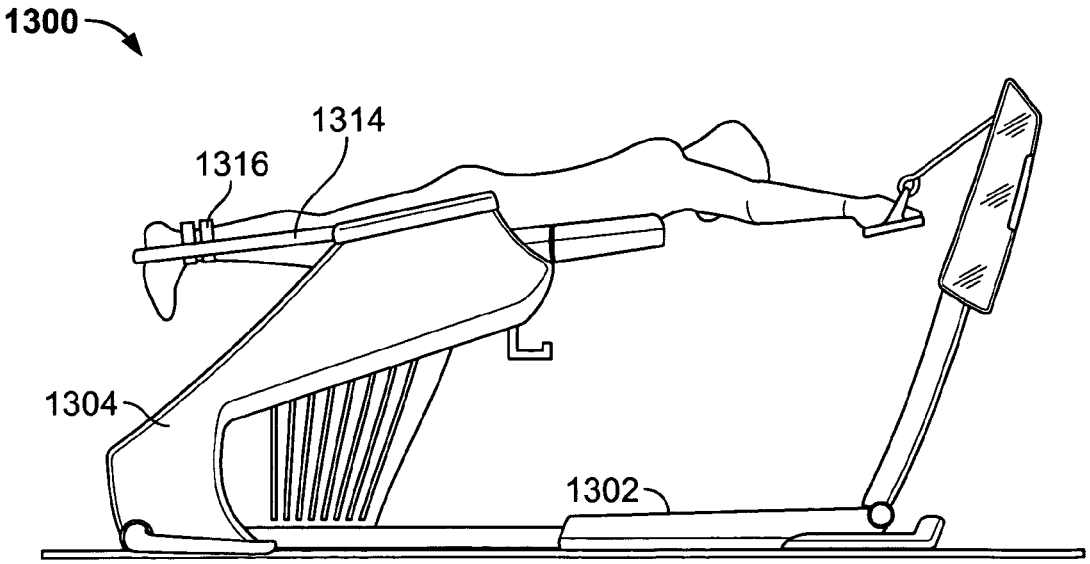

FIG. 13 illustrates an exercise device 1300 according to various other embodiments. The exercise device 1300 includes a base 1302 connected to and extending forward from a frame 1304. The frame 1304 may have an enclosure or body structure, as shown. The exercise device 1300 further includes a support mechanism 1306 connected to the frame 1304 and which supports a bench assembly 1308. The bench assembly 1308 is adapted to receive and support a torso of a user lying thereon, and is configured to rotate, with or without added resistance, to accommodate movement of a user.

A post 1310 is connected to the distal end of the base 1302 opposite the frame. The post 1310 can be rigidly connected to the base 1302, or connected via hinged mechanism so that the post 1310 can be pivoted around a hinge 1311 from a collapsed position and deployed in a substantially upright position. The base 1302 can be extendible to lengthen further from the frame 1304, and retractable for ease of storage or movement. To easily move the exercise device 1300, a user collapses the post 1310 to the base 1302, retracts the base 1302 toward the frame 1304, and can then grasp and lift one end of the exercise device 1300 by a handle 1315 to roll the exercise device 1300 on wheels 1313.

User operated cables 1312 extend out from the top of the post 1310 toward the bench assembly. The cables 1312 are connected at one end to a paddle or a handle and at another end to a cable resistance mechanism (not shown) housed inside the frame 1304. The cable resistance mechanism provides resistance to the cables 1312 while allowing the cables 1312 to retractably extend from the post, to provide a user with resistance to the user's arm motions when the user has grasped the paddle or handle. The cable resistance mechanism includes one or more of a flywheel, caliper brakes, alternator/generator device, electromagnetic or electromechanical clutch, hydraulic resistance device, or centrifugal clutch. The flywheel may be a wind-resistance flywheel, an electromechanical flywheel, or an electromagnetic flywheel.

Resistance for a user's leg movement is provided by leg resistance members 1314 that are connected at one end to the frame 1304 or bench assembly 1308, and extend backward horizontally or at a slight angle. The leg resistance members 1314 include a leg attachment mechanism 1316 at a distal end. The leg resistance members 1314 are preferably flexibly resilient poles or rods, and can be configured to provide adjustable resistance as described above with reference to FIG. 12. The leg attachment mechanism 1316 can include, without limitation, an ankle cuff, a foot receptacle such as a sandal or boot, and/or one or more straps configured to attach to a leg or foot of a user.

In some embodiments, the bench assembly 1308 includes a vibration generator (not shown) that generates vibration of all or part of the bench assembly 1308. The vibration stimulates muscles of a user engaged in exercise. The vibration generator can be adjusted to provide the vibration at any of a number of frequencies or intensity levels. In exemplary embodiments, the vibration generator includes one or more vibrating plates, controlled by the computer processor, and the frequency of vibration ranges from 20-60 Hz.

The post 1310 can also house a media device 1320 such as a graphical user interface, a set of light emitting diodes, or a video screen. The media device 1320 can also include an audio output. The media device 1320 is controlled by a computer processor (not shown) that also monitors the user's progress and/or exercise or movement status, history, and results. The computer processor is configured to run a computer program that can be stored locally in a memory in the exercise device, or which can be downloaded and run from a remote memory. Accordingly, the media device 1320 can provide historical or real-time monitoring and feedback of a user's performance.

The computer processor can control other devices that are part of or attachments to the exercise device 1300. In some embodiments, the exercise device 1300 includes an electromyogram (EMG) device (not shown) that records the electrical activity of selected muscles. For example, the EMG device can utilize surface EMG (SEMG) electrodes that are placed on the skin proximate to muscles to be evaluated. The EMG device feeds EMG data to the computer processor for output to a data output (not shown) or for display in the media device 1320. Historical EMG data can be stored locally or output to a database. The historical EMG data, or/and baseline or benchmark (goal) data, can be input to the computer processor for display in the media device 1320 via data input (not shown). Other physiological response measurement devices may be utilized.

In some embodiments, the computer processor is configured to analyze a user's exercise movement by measuring a power provided against a resistance mechanism (arm or leg). The measured power can be collected over a time period for generating an historical record of the analysis. Alternatively, the measured power can be compared to a benchmark or sample power profile, which may be graphically depicted in the media device 1320.

In some embodiments, an exercise movement technique can be analyzed. For instance, the computer processor can measure a power exerted by the user at a beginning of the movement, at the end of the movement, and at any point in time therebetween. Accordingly, with basic comparative knowledge of the movement, such as a baseline power profile of a swimmer's stroke, for example, the computer processor can calculate an efficiency and/or effectiveness of a user's exercise movement, or measure a performance of the user over time. Exercise movement analysis can be combined with the EMG data for a more detailed assessment of user performance.

Although a few embodiments have been described in detail above, other modifications are possible. Other embodiments may be within the scope of the following claims.

The invention claimed is:

1. An exercise apparatus comprising:

a bench assembly having a forward-ascending bench that is configured to support at least a torso of a user lying horizontally on the bench;

a frame that supports the bench assembly; and a leg resistance mechanism including:

a pair of flexible rods attached to and extending backward from the bench assembly, each flexible rod having a leg attachment mechanism for attaching to a leg of the user for aligning the leg in an exercise position and providing a calculated amount of resistance to movement of the leg radially from a longitudinal axis of the flexible rod at a first end; and an adjustment tract comprising a groove or series of holes into which a peg or pin connected to a second end of each rod is inserted for positioning the rod at a particular angle to provide a particular level of resistance.

2. An exercise apparatus in accordance with claim 1, wherein the bench is adapted for limited angular rotation about a forward-ascending axis through the bench assembly.

3. An exercise apparatus in accordance with claim 1, further comprising a base connected to and extending forward from the frame.

4. An exercise apparatus in accordance with claim 1, wherein the flexible rod is coupled to the bench assembly or the frame only at the second end.

5. An exercise apparatus in accordance with claim 4, wherein the first end of the flexible rod includes the leg attachment mechanism and is configured to bend without obstruction behind the bench assembly.

6. An exercise apparatus in accordance with claim 3, wherein the base is configured to telescope to extend from and retract toward the frame.

7. An exercise apparatus in accordance with claim 1, further comprising an arm resistance mechanism positioned forward of the bench assembly for providing resistance to movement of each arm of the user.

8. An exercise apparatus in accordance with claim 7, further comprising a post extending upward from the base, and wherein the arm resistance mechanism includes at least one cable extending from the post.

9. An exercise apparatus in accordance with claim 8, further comprising a cable resistance mechanism that provides resistance to movement of the at least one cable.

10. An exercise apparatus comprising:

a bench assembly having a forward-ascending bench that is configured to support at least a torso of a user lying horizontally on the bench;

a leg resistance mechanism including:

a pair of flexible rods attached to and extending backward from the bench assembly, each flexible rod having a leg attachment mechanism for attaching to a leg of the user for aligning the leg in an exercise position and providing resistance to movement of the leg radially from a longitudinal axis of the flexible resilient rod at a first end; and an adjustment tract comprising a groove or series of holes into which a peg or pin connected to a second end of each rod is inserted for positioning the rod at a particular angle to provide a particular level of resistance; and an arm resistance mechanism for providing resistance to movement of each arm of the user.

11. An exercise apparatus in accordance with claim 10, further comprising a frame that houses a variable resistance device for providing the resistance to the arm resistance mechanism.

12. An exercise apparatus in accordance with claim 11, wherein the bench assembly is connected to the frame such that the bench assembly rotates side-to-side.

13. An exercise apparatus in accordance with claim 11, wherein the bench assembly is connected to the frame such that the bench assembly moves forward and backward on the frame.

14. An exercise apparatus in accordance with claim 11, further comprising an electromyogram device to record electrical activity of selected muscles of a user of the exercise apparatus.

15. An exercise apparatus in accordance with claim 10, further comprising a computer processor that is configured to run a computer program to track and analyze exercise movements of a user of the exercise apparatus.

16. An exercise apparatus comprising:

a bench assembly having a torso support for supporting a torso of a user;

a leg resistance mechanism including:

a pair of flexible rods attached to and extending backward from the bench assembly, each flexible rod having a leg attachment mechanism for attaching to a leg of the user for aligning the leg in an exercise position and providing resistance to movement of the leg radially from a longitudinal axis of the flexible rod at a first end; and an adjustment tract comprising a groove or series of holes into which a peg or pin connected to a second end of each rod is inserted for positioning the rod at a particular angle to provide a particular level of resistance; and an arm resistance mechanism having at least one hand attachment provided forward of the bench assembly, the arm resistance mechanism providing resistance to movement of the hand attachment.

17. An exercise apparatus in accordance with claim 16, further comprising:

a base; and a frame mounted on the base, the frame including a variable resistance device providing variable resistance for the arm resistance mechanism.

18. An exercise apparatus in accordance with claim 16, further comprising a media device configured to provide status information to the user.

19. An exercise apparatus comprising:

a bench assembly having a torso support for supporting a torso of a user;

a leg resistance mechanism including:

a pair of flexible rods attached to and extending backward from the bench assembly, each flexible rod having a leg attachment mechanism for attaching to a leg of the user for aligning the leg in an exercise position and providing resistance to movement of the leg radially from a longitudinal axis of the flexible rod at a first end; and an adjustment tract comprising a groove or series of holes into which a peg or pin connected to a second end of each rod is inserted for positioning the rod at a particular angle to provide a particular level of resistance;

a base;

a frame mounted on the base, the frame including a variable resistance device providing variable resistance for the arm resistance mechanism;

a rail mounted on the frame and configured to allow forward and backward movement of the bench assembly; and a plurality of rollers connected with the rail and configured to allow side-to-side rotation of the bench assembly.

* * * * *